US005429787A

United States Patent [19]

Im et al.

[11] Patent Number: 5,429,787

[45] Date of Patent: Jul. 4, 1995

[54] METHOD FOR RAPID DRYING OF A POLYBENZAZOLE FIBER

[75] Inventors: Jang-hi Im; Chieh-Chun Chau, both of Midland, Mich.; Hiroki Murase, Ohtsu, Japan; Tooru Kitagawa, Ohtsu, Japan; Takaharu Ichiryu, Ohtsu, Japan

[73] Assignee: The Dow Chemical Company, Midland, Mich.

[21] Appl. No.: 142,526

[22] Filed: Nov. 2, 1993

Related U.S. Application Data

[63] Continuation-in-part of Ser. No. 985,080, Dec. 3, 1992, abandoned.

[51] Int. Cl.[6] ..... B29C 71/02

[52] U.S. Cl. ..... 264/344; 264/345

[58] Field of Search ..... 264/344, 345

[56] References Cited

U.S. PATENT DOCUMENTS

| | | | |
|---|---|---|---|
| 3,584,104 | 6/1971 | Bohrer et al. | 264/344 X |
| 3,619,453 | 11/1971 | Riggs | 264/344 X |
| 3,816,581 | 6/1974 | Prince, Jr. | 264/233 |
| 3,849,529 | 11/1974 | Ferment et al. | 264/85 |
| 3,883,718 | 5/1975 | Ferment et al. | 264/345 X |
| 4,419,317 | 12/1983 | Fujiwara et al. | 264/184 |
| 4,859,393 | 8/1989 | Yang et al. | 264/184 |
| 4,985,193 | 1/1991 | Allen | 264/184 |
| 5,273,703 | 12/1993 | Chau et al. | 264/184 |

OTHER PUBLICATIONS

Abstract of Japan 2-84,509, Published Mar. 26, 1990.
Abstract of Japan 2-84,511, Published Mar. 26, 1990.
Abstract of Japan 3-104,920, Published May 1, 1991.
Abstract of Japan 3-104,921, Published May 1, 1991.
Abstract of Japan 4-194,022, Published Jul. 14, 1992.
Wolfe, *Ency. Poly. Sci. and Eng.*, "Polybenzothiazoles and Polybenzoxazoles," 2nd Ed., vol. 11, pp. 601-635 (1988).
U.S. patent application Ser. No. 984,828 filed Dec.3, 1992.
U.S. patent application Ser. No. 985,060 filed Dec. 3, 1992.
U.S. patent application Ser. No. 985,078 filed Dec. 3, 1992.
U.S. patent application Ser. No. 985,068 filed Dec. 3, 1992.
U.S. patent application Ser. No. 985,067 filed Dec. 3, 1992.
*Ency. Poly. Sci. and Eng.*, 2nd Ed., vol. 11, pp. 572-601, 1988, J. Wiley & Sons Inc.

*Primary Examiner*—Leo B. Tentoni

[57] ABSTRACT

Polybenzazole fibers can be rapidly dried without undue fiber damage by exposing them to two or more set point temperatures with the temperatures being selected relative to the residual moisture content of the fiber. The residence time required for the fiber at each progressively higher temperature can be reduced if the fiber is always in full contact with the set point temperature of the drying equipment.

31 Claims, 3 Drawing Sheets

METHOD FOR RAPID DRYING OF A POLYBENZAZOLE FIBER

CROSS-REFERENCE TO RELATED APPLICATIONS

This is a continuation-in-part of application Ser. No. 07/985,080, filed on Dec. 3, 1992, now abandoned.

BACKGROUND OF THE INVENTION

The present invention relates to improved processes for drying polybenzazole fibers. Polybenzazole ("PBZ") fibers include polybenzoxazole ("PBO") or polybenzothiazole ("PBT") fibers.

Lyotropic liquid crystalline PBZ is typically made into fibers by dry-jet, wet-spinning techniques, in which a solution that contains the PBZ polymer and an acid solvent (known as a "dope") is spun through a spinneret to form dope filaments, that are combined into one or more dope fibers. These dope fibers are drawn across an air gap, and then contacted with a fluid that dilutes the solvent and is a non-solvent for the polymer. This contact with fluid causes the polymer to separate from the solvent. See jointly owned, Allowed, U.S. Pat. No. 5,296,185 (Method for Spinning a Polybenzazole Fiber) and U.S. Pat. No. 5,294,390 (Method for Rapid Spinning of a Polybenzazole Fiber), which are incorporated by reference, for a description of the PBZ fiber spinning process.

The process of separating the PBZ polymer in the dope fiber from the solvent in the dope fiber is known as coagulation. After coagulation, most of the remaining residual solvent is washed/leached from the coagulated fiber, leaving the fiber wet. See jointly owned, U.S. patent application Ser. No. 08/110,149 (Improved Process for Coagulation and Washing of Polybenzazole Fibers), which is incorporated by reference, for a description of the coagulation process.

Polybenzazole fibers typically contain a very high degree of residual moisture after they are washed. The residual moisture content is frequently between 30 and 200 weight percent, and may even be higher in some fibers. The percent residual moisture content, (hereinafter percent RMC) is calculated on a parts per hundred basis as follows:

$$[(\text{initial fiber weight} - \text{dried fiber weight})/\text{dried fiber weight}] \times 100\%.$$

For many reasons it is desirable to reduce the amount of residual moisture in the fiber by drying the fiber. One of the reasons it is desirable to reduce the amount of residual moisture in the fiber is to enable the fiber to be heat treated without damaging the fiber. Heat treating of dried fibers can be and is done to improve the fibers' physical properties. It has been discovered that PBZ fiber can be damaged by exposing it to the typical amount of heat (about 400° C.) used in heat treating while the fiber contains more than about twelve percent RMC. Therefore, in order to be heat treated without being damaged, a PBZ fiber usually must have a percent RMC of less than about twelve percent.

In order to reduce the amount of residual moisture in the fiber to below twelve percent RMC prior to the fiber being heat treated, it has heretofore been necessary to dry the fiber for over 40 hours at 65° C. It is economically undesirable to dry the fiber at this low temperature, because low temperature drying is, as noted above, very time-consuming and thus, very costly. It has been found that increasing the temperature of the drying process will speed up the drying process but can also cause damage to the fiber. This heat induced damage appears as visible voids in the fiber. These voids are highly undesirable for all PBZ fibers. Therefore, it is desirable to develop a process that allows for rapid drying of PBZ fiber without causing damage to the fibers.

SUMMARY OF THE INVENTION

The present invention is a process to rapidly dry a polybenzazole fiber that initially contains more than 30 percent residual moisture content, while minimizing damage to said fiber, said process comprising the step of exposing the fiber sequentially to two or more temperatures, wherein said temperatures are set relative to the percent residual moisture content of said fiber, and wherein each temperature set is hotter than the previous temperature, while allowing for brief periods of non-contact time during drying in which said fiber is not exposed to the full set point temperature, wherein the final percent residual moisture content of the fiber after it has been exposed to said two or more temperatures is about twelve percent or less.

The second aspect of this invention is a process to rapidly dry a polybenzazole fiber that initially contains more than 30 percent residual moisture content, while minimizing damage to said fiber, said process comprising the step of exposing the fiber sequentially to two or more temperatures, wherein said temperatures are selected relative to the percent residual moisture content of said fiber, and wherein each temperature selected is hotter than the previous temperature, and wherein the final percent residual moisture content of the fiber after it has been exposed to said two or more temperatures is about twelve percent or less.

DETAILED DESCRIPTION OF THE INVENTION

Figure 1:
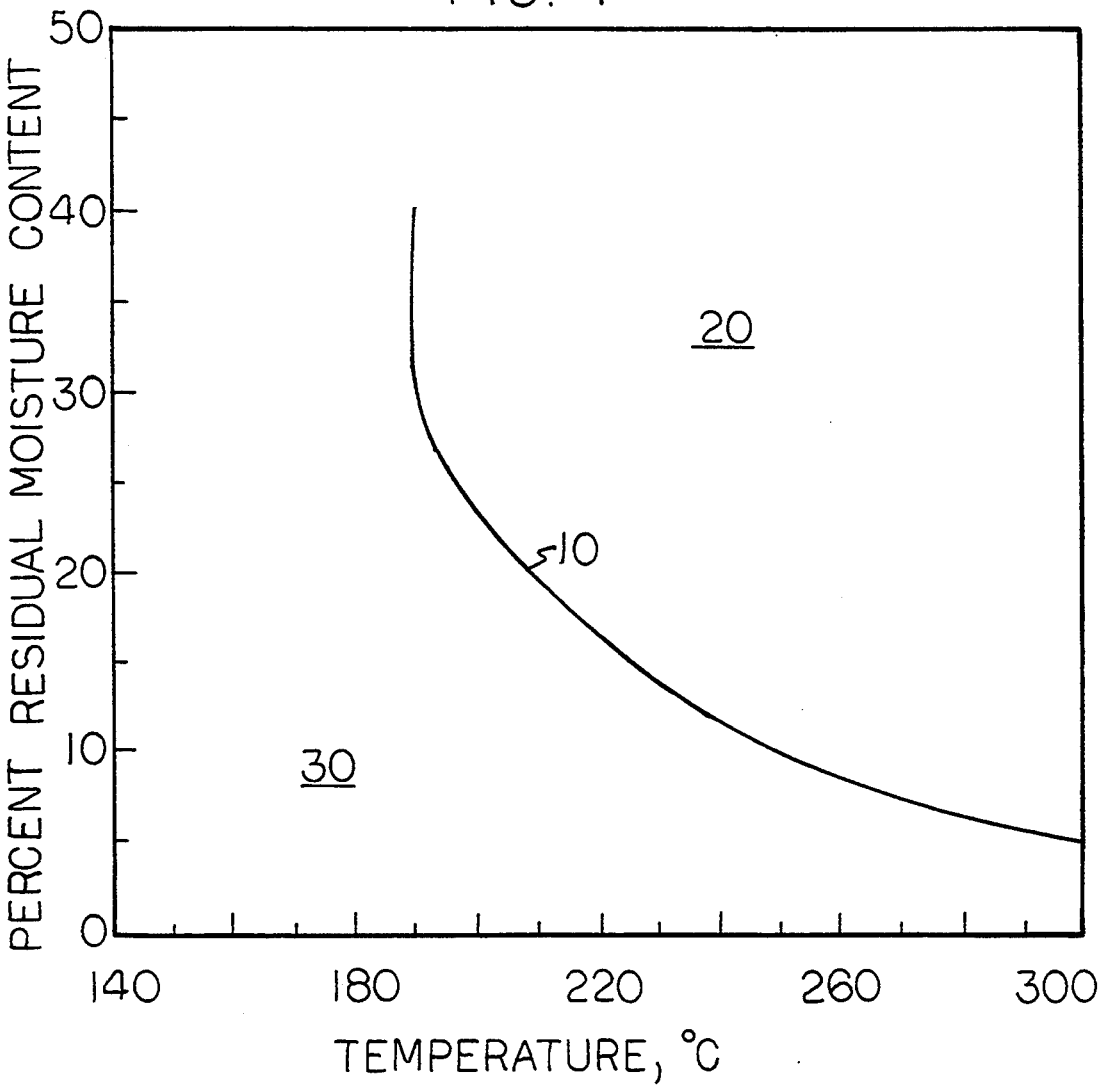
FIG. 1 shows a plot of Percent Residual Moisture Content of Polybenzoxazole Fiber vs. Temperature in °C. On this Figure there is a negatively sloped curved line 10 representing the boundary between an area 30, representing "safe" drying conditions and an area 20, representing "unsafe" drying conditions. This line 10 is referred to as the non-damage drying ("NDD") line for PBO fiber.

As used herein, the term polybenzazole ("PBZ") includes polybenzoxazole ("PBO") homopolymers, polybenzothiazole ("PBT") homopolymers and random, sequential and block copolymers of PBO or PBT.

Polybenzoxazole, polybenzothiazole and random, sequential and block copolymers of polybenzoxazole and polybenzothiazole are described in references such as Wolfe et al., *Liquid Crystalline Polymer Compositions, Process and Products*, U.S. Pat. No. 4,703,103 (Oct. 27, 1987); Wolfe et al. *Liquid Crystalline Polymer Compositions, Process and Products*, U.S. Pat. No. 4,533,692 (Aug. 6, 1985); Wolfe et al., *Liquid Crystalline Poly(2,6-Benzothiazole) Compositions, Process and Products*, U.S. Pat. No. 4,533,724 (Aug. 6, 1985); Wolfe, *Liquid Crystalline Polymer Compositions, Process and Products*, U.S. Pat. No. 4,533,693 (Aug. 6, 1985); Evers, *Thermooxidatively Stable Articulated p-Benzobisoxazole and p-Benzobisthiazole Polymers*, U.S. Pat. No. 4,359,567 (Nov. 16, 1982); and Tsai et al., *Method for Making Heterocyclic Block Copolymer*, U.S. Pat. No. 4,578,432 (Mar. 25, 1986) which are incorporated herein by reference.

Units within the PBZ polymer are preferably chosen so that the polymer is lyotropic liquid-crystalline. Preferred monomer units are illustrated in Formulae (a)–(h). The polymer more preferably consists essentially of monomer units selected from those illustrated in (a)–(h), and most preferably consists essentially of a number of identical units selected from those illustrated in (a)–(c).

(a)

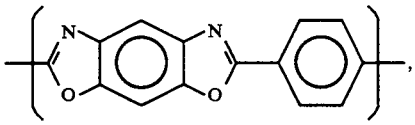

cis-polybenzoxazole
Poly[benzo(1,2-d:5,4-d')bisoxazole-2,6-diyl-1,4-phenylene]

(b)

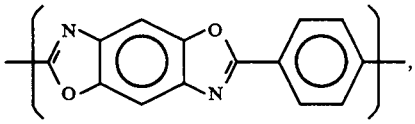

trans-polybenzoxazole
Poly[benzo(1,2-d:4,5-d')bisoxazole-2,6-diyl-1,4-phenylene]

(c)

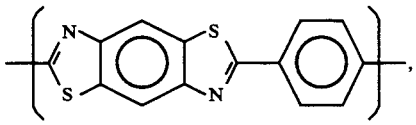

trans-polybenzothiazole (d)

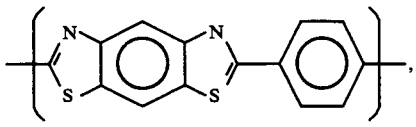

cis-polybenzothiazole (e)

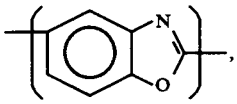

AB-PBO
Poly(2,5-benzoxazole)

-continued (f)

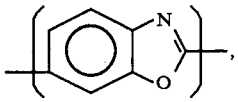

AB-PBO
Poly(2,6-benzoxazole)

(g)

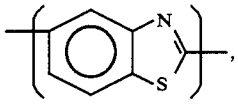

Poly(2,5-benzothiazole)

and (h)

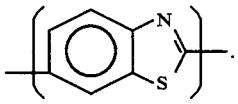

Poly(2,6-benzothiazole)

Solvents suitable for formation of dopes of PBZ polymers include cresol as well as non-oxidizing acids capable of dissolving the polymer. Examples of suitable acid solvents include polyphosphoric acid, methanesulfonic acid and highly concentrated sulfuric acid and mixtures of those acids. A highly preferred solvent is polyphosphoric acid or methanesulfonic acid. A most highly preferred solvent is polyphosphoric acid.

The concentration of the polymer in the solvent is preferably at least about 7 weight percent, more preferably at least about 10 weight percent and most preferably at least about 14 weight percent. The maximum concentration is limited primarily by practical factors, such as polymer solubility and, as already described, dope viscosity. Because of these limiting factors, the concentration of polymer is usually no more than about twenty weight percent.

Suitable polymers or copolymers and dopes can be synthesized by known procedures, such as those described in Wolfe et al., U.S. Pat. No. 4,533,693 (Aug. 6, 1985); Sybert et al., U.S. Pat. No. 4,772,678 (Sep. 20, 1988); and Harris, U.S. Pat. No. 4,847,350 (Jul. 11, 1989) which are incorporated herein by reference. PBZ polymers can be advanced rapidly to high molecular weight at relatively high temperatures and high shear in a dehydrating solvent acid, according to Gregory et al., U.S. Pat. No. 5,089,591 (Feb. 18, 1992), which is incorporated herein by reference.

MAKING THE FIBERS

The dope is spun into fibers by known dry jet, wet-spin techniques in which the dope is spun through a spinneret to form dope filaments that are collected together to form one or more dope fibers. Fiber spinning techniques for PBZ polymers are known in the references already mentioned in the Background of the Invention section.

After passing through an air gap the dope fiber(s) is/are contacted with a fluid that dilutes the solvent and is a non-solvent for the polymer. This process is known as coagulation. After coagulation, most of the remaining residual solvent is washed/leached from each fiber, leaving the fiber wet. See jointly owned, U.S. patent application Ser. No. 08/110,149 (Improved Process for Coagulation and Washing of Polybenzazole Fibers), for a description of the coagulation process.

DRYING THE FIBERS

The amount of residual moisture in the fiber after it has been washed can vary from more than 30 percent RMC all the way up to 200 percent RMC. As mentioned previously, there are many reasons to dry fiber, one of them being that it is necessary to remove all but a tiny amount of the moisture in the fiber in order to avoid damage to the fiber upon heat treating. Therefore, at the conclusion of the described drying process it is desirable that the percent residual moisture content of the fiber should preferably be twelve percent RMC or less, more preferably ten percent RMC or less, more highly preferably six percent RMC or less, most preferably four percent RMC or less and most highly preferably two percent RMC or less.

It has been found that selecting the highest temperature for rapid drying of PBZ fiber without damaging the fiber depends, in an inverse fashion, upon the moisture content of the fiber face out. The inverse relationship is such that the less moisture in the fiber, the higher the temperature the fiber can be exposed to without damaging the fiber. As the drying process continues and the moisture content of the fiber decreases, it is possible to increase the temperature the fiber is exposed to without damaging the fiber. The way to optimize (meaning increase) the drying rate for PBZ fiber is to increase the temperature the fiber is exposed to as fast as possible, but without exceeding the maximum safe temperature for each specific amount of residual moisture of the fiber.

Data has been collected regarding the relationship between percent RMC and temperature for drying of PBO fiber. The plot of this data has yielded the NDD line 10 shown in FIGS. 1, 2 and 3. This NDD line represents the maximum safe temperature that a PBO fiber can be exposed to at each specific percent RMC without causing drying-induced damage to the fiber.

The NDD line acts as a boundary between areas of "safe" drying conditions, area 30 on FIG. 1, and "unsafe" drying conditions, area 20 on FIG. 1. The highest drying temperatures that can be selected for drying each PBO fiber can be chosen simply by knowing the percent RMC of the fiber when it will first be exposed to the temperature. It is desirable to select the highest drying temperature possible for each fiber percent RMC in order to minimize the amount of time it takes to dry the fiber down to about twelve percent RMC or less. The number of drying temperatures used can be selected as a matter of process convenience, though it has been found desirable and necessary to have two or more drying temperatures, with each temperature selected to be progressively hotter than the previous temperature, in order to minimize the amount of time it takes to dry the fiber to a percent RMC about twelve percent or less.

Figure 2:
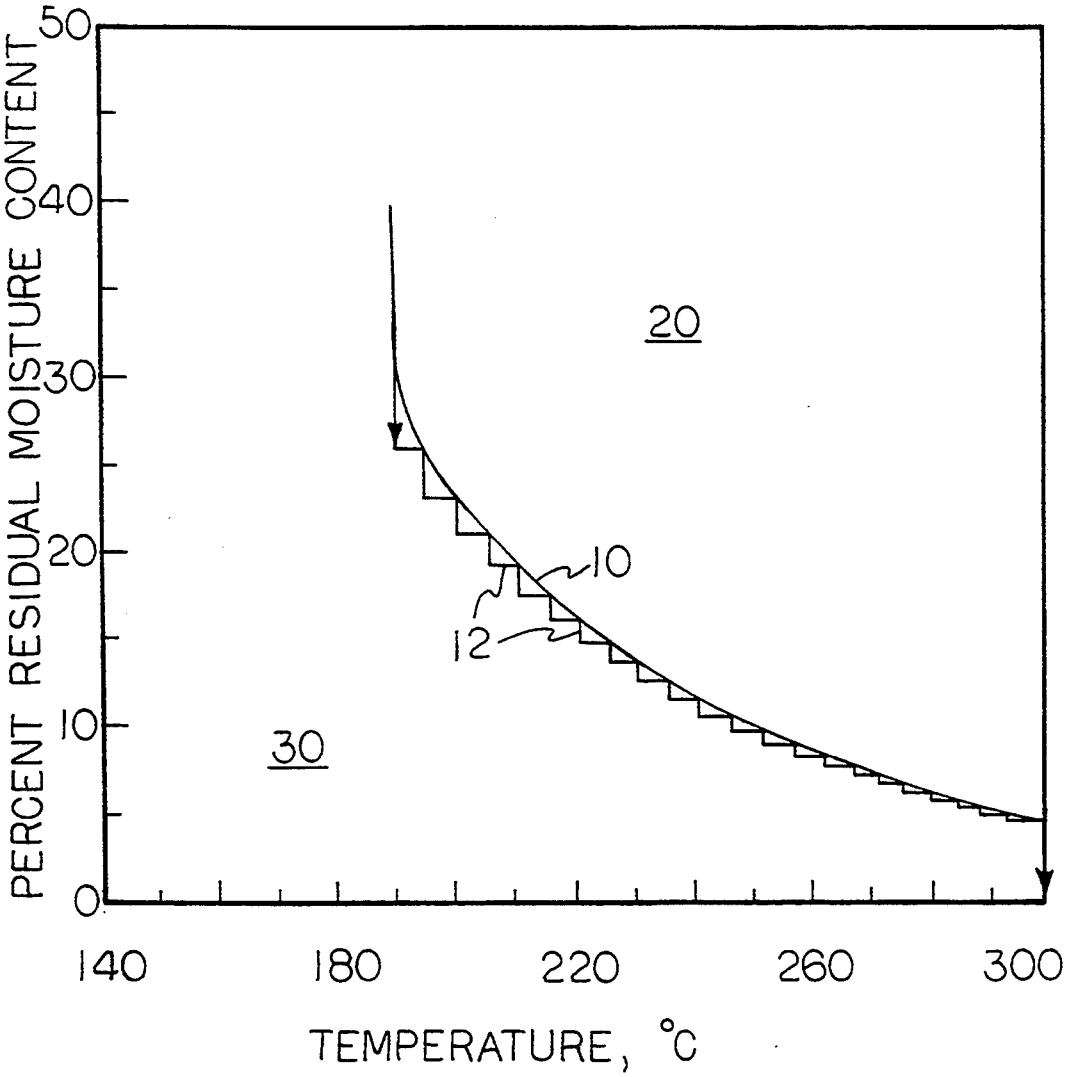
FIG. 2 shows the NDD line 10 on a plot of Percent Residual Moisture Content of Polybenzoxazole Fiber vs. Temperature in °C., along with a series of vertical and horizontal lines 12 representing the drying profile for a PBO fiber wherein the temperature the PBO fiber is exposed to is continuously increased as the moisture content of the fiber is reduced. In this Figure the drying profile all takes place on the "safe" area 30, of the plot.

FIG. 2 illustrates a multiple-temperature drying process in which twenty-three progressively hotter temperatures are used to dry a PBO fiber from a starting percent RMC above forty percent to a final percent RMC below five percent. The temperatures selected relative to the percent RMC of the fiber in this drying profile are as close as possible to the NDD line without crossing it. This manner of selection insures the most rapid drying process for the fiber without creating voids in the fiber during drying.

The morphology and physical state of the PBZ fiber being dried can vary with the dope composition, the polymer formulation and the specific fiber processing conditions, therefore, the highest temperature a PBZ fiber can be exposed to at each percent RMC without being damaged can vary. As a consequence of this, the NDD line for each PBZ fiber and for the same PBZ polymer processed under different conditions, can and will vary, with the amount of variance depending upon the degree in differences between any or all of, but not limited to, the following factors, a) Processing damage within the fiber, prior to its being dried,
b) Porosity of the fiber,
c) Fiber processing conditions,
d) Residual chemicals such as residual acids, impurities and the like, or
e) Additives or processing aids in the fibers.

In practice, one type of standard equipment used to dry fibers includes matched pairs of heated rolls. The fiber is wrapped over these rolls many times in order to increase the amount of contact time the fiber has with the heated roll. Contact time is defined as the amount of time the fiber is in direct contact with the set point temperature of the heated roll (or other heating device that can be used for drying PBZ fiber). It is assumed that a fiber in contact with a heated roll is at the same temperature as the surface of the roll. It is also assumed that the surface temperature of the roll is the same as the set point temperature of the roll, that is, a heated roll with a set point temperature of 180° C. should have a surface temperature of 180° C. The set point temperature of a heating device is defined herein as the temperature the heating mechanism of the heating device is set at.

In addition to contact time with the heated roll, the fiber must travel between each pair of heated rolls before it recontacts a roll or before it travels on to the next pair of heated rolls. The time the fiber is not in contact with a heated roll or any other direct source of heat during the drying process is referred to as non-contact time, The total residence time of a fiber during the drying process is the contact time (CT) plus the non-contact time (NCT). When the fiber is not in direct contact with a heated roll, the fiber temperature is less than that of the heated roll. Therefore, this invention contemplates that as the fiber is exposed to progressively increasing temperatures, that if the fiber is being dried by heated rolls, then there will be brief moments during the drying process when the fiber is not exposed to the full set point temperature of the heated rolls.

It is believed that the fiber continues to undergo drying during its NCT with the heated roll, but that the drying of the fiber during NCT is not as efficient drying as that drying the fiber undergoes during its CT with the heated roll. One way to increase the efficiency of the drying process is to insulate the cabinets that the pairs of heated rolls are usually positioned in, and to blow hot air or a gas that does not damage the fiber, such as nitrogen, helium, argon or carbon dioxide, into the cabinets so that the temperature throughout the cabinet is the same as the set point temperature of the heated rolls. Another way to more efficiently dry fibers is to pass them through progressively heated ovens in which the temperature of each oven is progressively increased such that the fibers are continually exposed to the set point temperature of each oven. With both of these more efficient methods of drying the residence time of the fiber is made up of only contact time without any non-contact time. Contact time is, as has already been stated, much more efficient drying time than is non-contact time. With these more efficient methods of drying, it is possible to reduce the residence time required to reach a certain percent RMC in the fiber as follows. To achieve a certain percent residual moisture content in a fiber using drying conditions with only contact time (such as drying the fiber in continuous ovens or using drying rolls positioned in insulated cabinets with means to keep entire interior of cabinet at set point temperature of heated rolls), the residence time to achieve a certain percent RMC is about two-thirds or less of what is required when drying is carried out with the contact time and a non-contact time component (such as when drying is carried out using heated rolls positioned in non-insulated drying cabinets).

The total amount of residence time, when there is both a CT and a NCT component to the residence time, required to dry a PBZ fiber to less than about twelve percent RMC should preferably be no more than about 10 minutes, more preferably be no more than about 5 minutes, and most preferably be no more than about 3 minutes. The total amount of residence time, where there is only a CT component (no NCT component) of residence time, required to dry a PBZ fiber to less than about twelve percent RMC should preferably be no more than about 6 minutes, more preferably be no more than about 3 minutes, and most preferably be no more than about 2 minutes. The total amount of residence time, when there is both a CT and a NCT component to the residence time, required to dry a PBZ fiber to less than about two percent RMC should preferably be no more than about 20 minutes, more preferably be no more than about 15 minutes, and most preferably be no more than about 10 minutes. The total amount of residence time, when there is only a CT component (no NCT component) of residence time, required to dry a PBZ fiber to a level of percent RMC of less than two percent RMC should preferably be no more than about 14 minutes, more preferably be no more than about 10 minutes, and most preferably be no more than about 7 minutes.

In order to dry the fiber to a certain residual moisture content in the amount of time specified in the preceding paragraphs, it is desirable to start the drying process at a certain minimum temperature. Accordingly, the minimum first temperature the fiber should be exposed to is at least about 140° C., preferably at least about 150° C., more preferably at least about 160° C., more highly preferably at least about 170° C., and most preferably at least about 180° C. It is desirable to minimize the amount of time it takes to dry the fiber. It has been found that selecting intermediate process temperatures close to those temperatures on the NDD line, without going higher than those temperatures on the NDD line (as illustrated by the series of vertical and horizontal lines 12 in FIG. 2) allows the most rapid drying of PBZ fiber, without creating voids. Typically, final drying temperatures do not excess 300° C., preferably do not exceed 280° C. and most preferably do not exceed 260° C.

The drying process is concluded when the percent RMC of the fiber has reached the desired level. Drying is preferably continued until the fiber exiting the drying equipment contains at most about twelve percent RMC, preferably at most about 10 percent RMC, more preferably at most about 8 percent RMC, more highly preferably at most about 6 percent RMC, most preferably at most about 4 percent RMC and most highly preferably at most about 2 percent RMC.

After the fiber is dried, it may optionally be heat treated to improve its physical properties. Heat-treatment of PBZ fiber is described in jointly owned, Allowed, U.S. Pat. No. 5,288,445 (Rapid Heat Treatment Method for Polybenzazole Polymer) and U.S. Pat. No. 5,288,452 (Steam Heat-Treatment Method for Polybenzazole Fiber).

Operating by this drying method permits rapid drying of PBZ fiber while minimizing damage to the fiber. Minimizing the amount of damage inflicted upon PBZ fiber is desirable.

ILLUSTRATIVE EXAMPLES

The following examples are for illustrative purposes only. They should not be taken as limiting the scope of either the specification or the claims. Unless stated otherwise, all parts and percentages are by weight.

In these examples, the percent residual moisture Content (percent RMC) is determined by a gravimetric method as follows: Approximately 0.5 grams of fiber sample is collected and weighed on a balance. The samples are heated in an oven at 250° C. for thirty minutes to remove the residual moisture and weighed again. The percent RMC is determined by calculating [(initial sample weight−dried sample weight)/dried sample weight]×100 percent.

In these examples, the void content and distribution are determined using a visual microscopic method. Three inch long samples of fiber are cut and end-taped on microscopic slides and observed under a light microscope at 200X magnification. Voids usually appear as blotches or dark striations along the fiber. They can vary in size, number and thickness among fiber samples. The void content is qualitatively rated as void free, slight voids and many voids.

EXAMPLES

Example of Damage Drying and Non-Damage Drying

A spinning dope that contains 14 percent cis-polybenzoxazole (I.V. 30 g/dL) dissolved in polyphosphoric acid is extruded at 160° C. from a spinneret that contains 166 orifices, with each orifice having a diameter of 0.22 mm. The resulting filaments are drawn across an air gap of 22 cm and immersed in an aqueous coagulation bath maintained at a temperature of about 22° C. The filaments are combined into a fiber and the fiber is washed with water as it passes sequentially over rolls.

The fiber is dried using 3 matched pairs of heated drying rolls with each pair of heated drying rolls set up in separate, uninsulated drying cabinets. Each pair of heated drying rolls has the same set point temperature. The residence time in each cabinet is the sum of the amount of time the fiber is in contact with the rolls (CT) plus the amount of time the fiber is not in contact with each roll (non-contact time or NCT). After drying, the physical properties of the dried fiber are measured.

Figure 3:
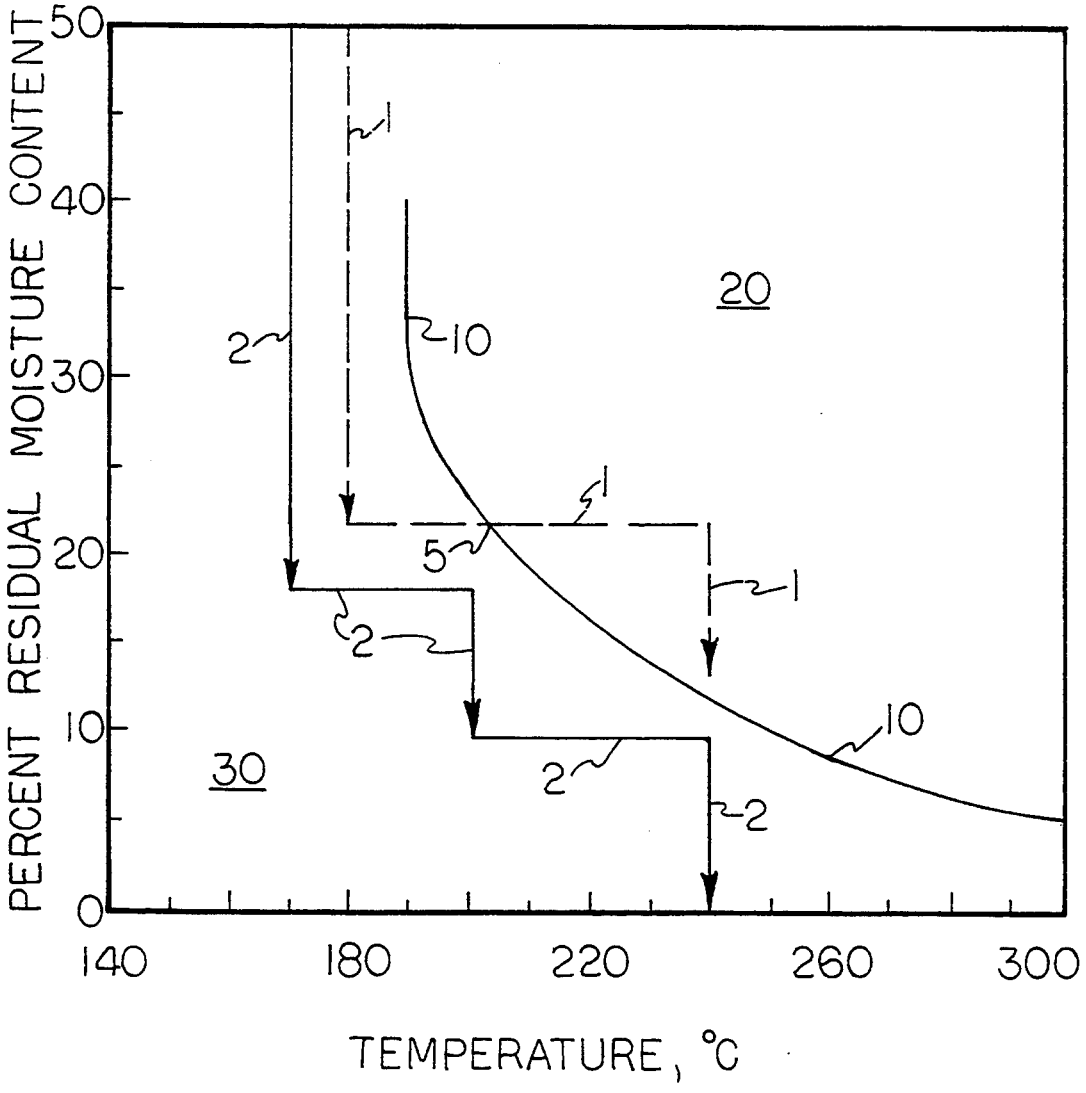
FIG. 3 shows the NDD line 10 on a plot of Percent Residual Moisture Content of Polybenzoxazole Fiber vs. Temperature in °C., along with drying profile lines 1 and 2 representing the reduction of RMC in two separate PBO fibers as they are exposed to progressively elevated temperatures.

FIG. 3 shows the drying profile lines of the fibers described in the following examples.

Comparative Example

In FIG. 3, the line marked 1 is the drying profile line for Fiber 1. Fiber 1 is moved at 200 meters/minute through the drying process. Drying profile line 1 for Fiber 1 show that this fiber is dried at 180° C. (residence time 42 seconds), until its moisture level is below 25 percent, then it is dried at 240° C. (residence time 121 seconds) until its moisture level is below 15 percent. The drying profile line 1 crosses the NDD line at position 5. The fiber has a tensile strength of 33.8 g/d, a tensile modulus of 1671 g/d and an elongation to break of 2.46 percent. This fiber has many visible voids present. THIS FIBER IS NOT AN EXAMPLE OF THIS INVENTION.

Example of the Invention

In FIG. 3, the line marked 2 is the drying profile line for Fiber 2. Fiber 2 is moved at 100 meters/minute through the drying process Line 2 shows that Fiber 2 is dried first at 170° C. (residence time of 84.3 seconds), until its moisture level is below 20 percent then it is dried at 200° C. (residence time of 84.3 seconds) until its moisture level is below 10 percent and then it is dried at 240° C. (residence time of 79.3) until its moisture level is below 3 percent. At a total residence time of 4.1 minutes, this fiber's ending percent RMC is 3.0 percent. When the amount of residence time for this fiber at 240° C. is extended to 158.6 seconds, the fiber's ending percent residual moisture content drops to 1.0 percent. At no time does the drying profile line, 2, for this fiber cross the NDD line. This fiber has a tensile strength of 38.0 to 39.3 g/d, a tensile modulus of 1616–1624 g/d and an elongation to break of 2.86 to 3.00 percent. This fiber does not have visible voids at the conclusion of the drying process.

Example of Drying Using Contact Time and Noncontact Time Versus Drying Using only Contact Time A polybenzoxazole fiber is provided with a certain percent RMC.

One segment of this fiber is dried at a 100/meters minute line speed using heated rolls positioned in a non-insulated cabinet (residence time with contact time and non-contact time components). The first pair of heated rolls has a set point temperature of 180° C., the second pair of heated rolls has a set point temperature of 200° C., and the third pair of heated rolls has a set point temperature of 220° C. The total residence time for the PBO fiber is the sum of all the residence times (33.7 sec CT at each set point temperature and 50.6 seconds NCT at each set point temperature). The total residence time for the PBO fiber dried in this manner to reach 4.8 percent RMC is about 4.2 minutes.

The same fiber is dried at 100 m/minute using heated rolls positioned in insulated cabinets wherein the interior temperature of each cabinet is maintained at the set point temperature of the heated rolls contained within it (residence time with only a contact time component). The set point temperature pattern of the rolls are the same as the set point temperatures of the fiber dried with both a CT and a NCT component. The total residence time for the PBO fiber dried in this manner to reach 4.8 percent RMC is about 2.4 minutes.

What is claimed is:

1. A process to rapidly reduce the moisture content of a polybenzazole fiber from above 30 percent by weight to 12 percent by weight or less of the fiber while minimizing damage to the fiber, which comprises heating the fiber with at least two heating devices arranged in sequence, each having a set point temperature, wherein (a) each heating device has a set point temperature of at least about 140° C., (b) each heating device after the first device has a set point temperature the same or above the set point temperature of the proceding device, (c) the set point temperature of at least one heating device is set higher than the preceding device, and (d) the set point temperatures of the heating devices are set relative to the residual moisture content of the fiber.

2. The process of claim 1 wherein the residual moisture content of the fiber is reduced to 10 percent by weight or less of the fiber.

3. The process of claim 1 wherein the residual moisture content of the fiber is reduced to 6 percent by weight or less of the fiber.

4. The process of claim 1 wherein the residual moisture content of the fiber is reduced to 4 percent by weight or less of the fiber.

5. The process of claim 1 wherein the residual moisture content of the fiber is reduced to 2 percent by weight or less of the fiber.

6. The process of claim 1 which is carried out in less than about 20 minutes.

7. The process of claim 1 which is carried out in less than about 15 minutes.

8. The process of claim 1 which is carried out in less than about 10 minutes.

9. The process of claim 1 wherein one heating device has a set point temperature higher than the preceding device.

10. The process of claim 1 wherein the fiber is exposed to at least three heating devices and at least two heating devices have a set point temperature higher than the preceding devices.

11. The process of claim 1 wherein each heating device has a set point temperature of at least about 150° C.

12. The process of claim 1 wherein each heating device has a set point temperature of at least about 170° C.

13. The process of claim 1 wherein each heating device has a set point temperature of at least about 180° C.

14. The process of claim 1 in which said polybenzazole fiber is polybenzoxazole fiber.

15. The process of claim 1 in which said polybenzazole fiber is polybenzothiazole fiber.

16. A process to rapidly dry a polybenzazole fiber that initially contains more than 30 percent RMC, while minimizing damage to said fiber, said process comprising the step of exposing said fiber sequentially to two or more temperatures, wherein said temperatures are selected relative to the percent residual moisture content of said fiber, and wherein each temperature selected is hotter than the previous temperature, and wherein the final percent residual moisture content of said fiber after it has been exposed to said two or more temperatures is about twelve percent or less.

17. The process of claim 16 in which said final percent residual moisture content of the fiber after it has been exposed to said two or more temperatures is about 10 percent or less.

18. The process of claim 16 in which said final percent residual moisture content of the fiber after it has been exposed to said two or more temperatures is about 6 percent or less.

19. The process of claim 16 in which said final percent residual moisture content of the fiber after it has been exposed to said two or more temperatures is about 4 percent or less.

20. The process of claim 16 in which said final percent residual moisture content of the fiber after it has been exposed to said two or more temperatures is about 2 percent or less.

21. The process of claim 16 in which the total residence time the fiber is exposed sequentially to two or more temperatures is less than about fourteen minutes.

22. The process of claim 16 in which the total residence time the fiber is exposed sequentially to two or more temperatures is less than about ten minutes.

23. The process of claim 16 in which the total residence time the fiber is exposed sequentially to two or more temperatures is less than about seven minutes.

24. The process of claim 16 in which the number of temperatures said fiber is exposed to is two.

25. The process of claim 16 in which the number of temperatures said fiber is exposed to is three.

26. The process of claim 16 in which the first of said two or more temperatures is at least about 140° C.

27. The process of claim 16 in which the first of said two or more temperatures is at least about 150° C.

28. The process of claim 16 in which the first of said two or more temperatures is at least about 170° C.

29. The process of claim 16 in which the first of said two or more temperatures is at least about 180° C.

30. The process of claim 16 in which said polybenzazole fiber is polybenzoxazole fiber.

31. The process of claim 16 in which said polybenzazole fiber is polybenzothiazole fiber.

* * * * *

UNITED STATES PATENT AND TRADEMARK OFFICE

CERTIFICATE OF CORRECTION

PATENT NO. : 5,429,787

DATED : July 4, 1995

INVENTOR(S) : Jang-Hi Im, Chieh-Chun Chau, Hiroki Murase, Tooru Kitagawa, Takaharu Ichiryu It is certified that error appears in the above-indentified patent and that said Letters Patent is hereby corrected as shown below:

Claim 1, Col. 10, line 2, "proceding" should read -- preceding —.

Signed and Sealed this

Thirty-first Day of December, 1996

*Attest:*

Bruce Lehman

BRUCE LEHMAN

*Attesting Officer*

*Commissioner of Patents and Trademarks*